US006886737B2

(12) United States Patent
Dye

(10) Patent No.: US 6,886,737 B2
(45) Date of Patent: May 3, 2005

(54) POINT-OF-PURCHASE DISPLAY WITH INDICIA PANEL

(75) Inventor: Robert George Dye, Glen Ridge, NJ (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 0 days.

(21) Appl. No.: 10/352,796

(22) Filed: Jan. 28, 2003

(65) Prior Publication Data

US 2004/0144837 A1 Jul. 29, 2004

(51) Int. Cl.[7] ..... B65D 51/00

(52) U.S. Cl. ..... 229/102.5; 229/164; 206/45.21; 206/767; 206/768

(58) Field of Search ..... 229/104, 102.5, 229/164, 195, 198, 190; 206/736, 737, 45.21, 767, 768, 45.29

(56) References Cited

U.S. PATENT DOCUMENTS 1,860,309 A * 5/1932 Davidson ..... 206/45.21
1,903,461 A * 4/1933 Keller ..... 206/45.29
2,259,041 A * 10/1941 Larkin ..... 206/766
3,107,040 A * 10/1963 Ullger ..... 229/117.07
3,164,350 A * 1/1965 Taub ..... 206/764
3,574,884 A * 4/1971 Palmer ..... 15/257.06
3,912,158 A * 10/1975 Taub ..... 229/117.07
4,101,068 A * 7/1978 Buck ..... 229/196
4,128,167 A * 12/1978 Hogshead, III ..... 206/45.29
4,206,869 A * 6/1980 Gurevitz ..... 229/117.18
4,244,509 A * 1/1981 Dlugopolski ..... 206/509
4,433,778 A * 2/1984 Maio et al. ..... 206/45.25
6,109,514 A * 8/2000 Otis ..... 229/125.19

* cited by examiner

*Primary Examiner*—Tri M. Mai
(74) *Attorney, Agent, or Firm*—Armstrong Teasdale LLP

(57) ABSTRACT

An open-topped, open-fronted tray for displaying articles for purchase is provided with a reinforced, drop-down flap for bearing advertising or product information indicia or the like. The drop-down flap has an exposed outer surface, which is contiguous with the remaining outer surfaces of the tray, so that only one side of the flat blank, prior to articulation, needs to be printed or otherwise have indicia applied thereto. A blank for forming the point of purchase display tray, and a method for employing the point of purchase display tray, are also disclosed.

25 Claims, 10 Drawing Sheets

POINT-OF-PURCHASE DISPLAY WITH INDICIA PANEL

BACKGROUND OF THE INVENTION

1. Field of the Invention

The present invention relates to tray displays, for point of purchase display of goods, which displays are often located on retail store shelves or on check-out counters in stores. The present invention is directed in particular to open-fronted and open-topped point-of-purchase displays.

2. The Prior Art

Point of purchase display trays, for the contained display of retail products are known. Such point of purchase displays may be either of a self-supporting stand variety, or they may be of the countertop or display shelf oriented variety. Either variety may be used in a manner in which the goods to be displayed are placed within the display prior to its shipment to the ultimate point of purchase location.

For point of purchase displays which are of the countertop or display shelf variety, the front face of the display tray will be substantially open when the display tray is configured into its display mode, may have little or no structure in the form of a front wall, so as to maximize customer accessibility and ease of removal of goods from within the tray. Typically, there may be a very low front wall extending across some or all of the front opening of the display tray.

However, there is a countervailing desire to provide for the placement of indicia in a prominent manner on the tray itself, so that it is not necessary to rely upon the packaging of the goods themselves within the tray (which may be obscured by the orientation of the goods, or otherwise not so prominent) or upon indicia provided by the store proprietor, along the edge of the shelf.

Some point of purchase display tray manufacturers have attempted to address these issues by providing a flap (of a single thickness of material) extending from the front wall of the display tray, which flops down, in front of the front wall, to expose an enlarged area of display surface. However, because this exposed surface is part of the "inside" surface of the blank for the tray (if contiguously formed with the rest of tray), then both sides of the blank must have their surfaces printed or have indicia bearing decals placed thereon. Alternatively, the so-described display flap would have to be formed from a discrete piece of blank material, or a segregated portion of the same piece of blank material that the bulk of the tray is configured.

Therefore, it is desirable to provide a point of purchase display, which is provided with a display flap, that is contiguously and monolithically formed as part of the same blank as the tray portion of the display.

It would also be desirable to provide a point of purchase display, which is provided with a display flap, that does not require two-sided printing on or other double-sided application of indicia to the blank for the display.

These and other desirable characteristics of the present invention will become apparent in view of the present specification and drawings.

SUMMARY OF THE INVENTION

The present invention is directed in part to a point of purchase display tray for the containment and presentation of articles for vending, comprising a bottom panel, having a front edge, a rear edge and two side edges; a first rear panel emanating upwardly from the rear edge of the bottom panel;

two first end panels, emanating upwardly from respective ones of the side edges of the bottom panel, a front panel, emanating upwardly from the front edge of the bottom panel; a reinforcing panel, foldably emanating from a top edge of the front panel; and a panel for bearing indicia, emanating from an edge of the reinforcing panel disposed distal to the top edge of the front panel, the panel for bearing indicia being folded back upon and affixed to the reinforcing panel, to form a display panel pivotably connected to the front panel that is pivotably movable between a raised position above the front panel, and a display position outwardly and in front of the front panel, to expose indicia on the panel for bearing indicia. The bottom panel, first rear panel, first end panels, front panel, reinforcing panel and panel for bearing indicia are all monolithically formed as part of a single blank of material. The panel for bearing indicia has a display surface that is exposed and outwardly facing when the panel for bearing indicia is in its display position, the display surface being disposed on a side of the blank in common with outwardly facing surfaces of the bottom panel, first rear panel, first end panels and front panel.

The point of purchase display tray preferably further comprises two rear panel flaps emanating from side edges of the first rear panel; the two rear panel flaps being juxtaposed against respective inwardly facing surfaces of the two first end panels.

The point of purchase display tray preferably further comprises two second end panels, emanating downwardly from top edge regions of respective ones of the two first end panels, and juxtaposed against respective inwardly facing surfaces of the two rear panel flaps, so that the respective rear panel flaps are captured between respective pairs of first and second end panels.

The point of purchase display tray may further comprise a second rear panel, emanating from a top edge of the first rear panel, and extending downwardly toward the bottom panel. Reinforcing flaps may be provided, foldably emanating from rear edges of the second end panels and juxtaposed adjacent an inwardly facing surface of the first rear panel.

The point of purchase display tray may further comprise two end panel flaps, foldably emanating from front edges of the two first end panels and juxtaposed against inwardly facing surfaces thereof. At least one tab may be provided, emanating from a bottom edge of at least one of the two end panel flaps; with at least one slot disposed in the bottom panel, operably positioned to insertingly receive the at least one tab, when the respective end panel flap is juxtaposed against the inwardly facing surface of its corresponding one of the two first end panels.

The point of purchase display tray may further comprise at least one tab emanating from a bottom edge of the second rear panel; and at least one slot disposed in the bottom panel, operably positioned to insertingly receive the at least one tab.

At least one gusset structure may be provided, interconnecting the front panel with a corresponding at least one of the two first end panels.

At least one tab may be provided, emanating from a free edge of at least one of the second end panels; with at least one slot disposed in the bottom panel, and operably positioned so as to insertingly receive the at least one tab when the respective at leas tone of the second end panels is juxtaposed against an inwardly facing surface of its corresponding rear panel flap.

The point of purchase display tray may further comprise at least one front panel flap emanating from an end edge of the front panel and extending rearwardly toward the rear edge of the bottom panel.

The invention also is directed, in part, to a blank for a point of purchase display tray for the containment and presentation of articles for vending, comprising a bottom panel, having a front edge, a rear edge and two side edges; a first rear panel emanating from the rear edge of the bottom panel; two first end panels, emanating from respective ones of the side edges of the bottom panel; a front panel, emanating from the front edge of the bottom panel; a reinforcing panel, foldably emanating from an outer edge of the front panel; and a panel for bearing indicia, emanating from an edge of the reinforcing panel disposed distal to the outer edge of the front panel. The bottom panel, first rear panel, first end panels, front panel, reinforcing panel and panel for bearing indicia are all monolithically formed as part of the blank. The panel for bearing indicia has a display surface disposed on a side of the blank in common with outwardly facing surfaces of the bottom panel, first rear panel, first end panels and front panel.

The blank may further comprise two rear panel flaps emanating from side edges of the first rear panel. Two second end panels may be provided, emanating from outer edge regions of respective ones of the two first end panels. A second rear panel may be provided, emanating from an outer edge of the first rear panel.

The blank may further comprise reinforcing flaps, foldably emanating from rear edges of the second end panels. Two end panel flaps may be provided, foldably emanating from front edges of the two first end panels. The blank may further comprise at least one tab emanating from an inner edge of at least one of the two end panel flaps; and at least one slot disposed in the bottom panel.

The blank may further comprise at least one tab emanating from an outer edge of the second rear panel; and at least one slot disposed in the bottom panel. At least one gusset structure may be provided, interconnecting the front panel with a corresponding at least one of the two first end panels. At least one tab may be provided, emanating from a free edge of at least one of the second end panels; with a corresponding at least one slot disposed in the bottom panel.

At least one front panel flap may be provided, emanating from an end edge of the front panel.

The present invention is further directed, in part, to a method for packaging, transporting and displaying goods, comprising the steps of:

providing a point of purchase display tray for the containment and presentation of articles for vending, the point of purchase display tray including a bottom panel, having a front edge, a rear edge and two side edges;

a first rear panel emanating upwardly from the rear edge of the bottom panel;

two first end panels, emanating upwardly from respective ones of the side edges of the bottom panel, a front panel, emanating upwardly from the front edge of the bottom panel;

a reinforcing panel, foldably emanating from a top edge of the front panel;

a panel for bearing indicia, emanating from an edge of the reinforcing panel disposed distal to the top edge of the front panel, the panel for bearing indicia being folded back upon and affixed to the reinforcing panel, to form a display panel pivotably connected to the front panel that is pivotably movable between a raised position above the front panel, and a display position outwardly and in front of the front panel to expose indicia on the panel for bearing indicia, the bottom panel, first rear panel, first end panels, front panel, reinforcing panel and panel for bearing indicia all being monolithically formed as part of a single blank of material;

the panel for bearing indicia having a display surface that is exposed and outwardly facing when the panel for bearing indicia is in its display position, the display surface being disposed on a side of the blank in common with outwardly facing surfaces of the bottom panel, first rear panel, first end panels and front panel;

providing indicia on the display surface of the panel for bearing indicia prior to articulation of the blank into the point of purchase display tray;

filling the point of purchase display tray with products;

positioning the display panel in its raised position;

placing the point of purchase display tray into a shipping container.

The method may further comprise the steps of:

transporting the shipping container to a store.

The method may further comprise the steps of:

opening the shipping container;

placing the point of purchase display tray on a surface;

positioning the display panel in the display position.

DETAILED DESCRIPTION OF THE DRAWINGS

Figure 1:
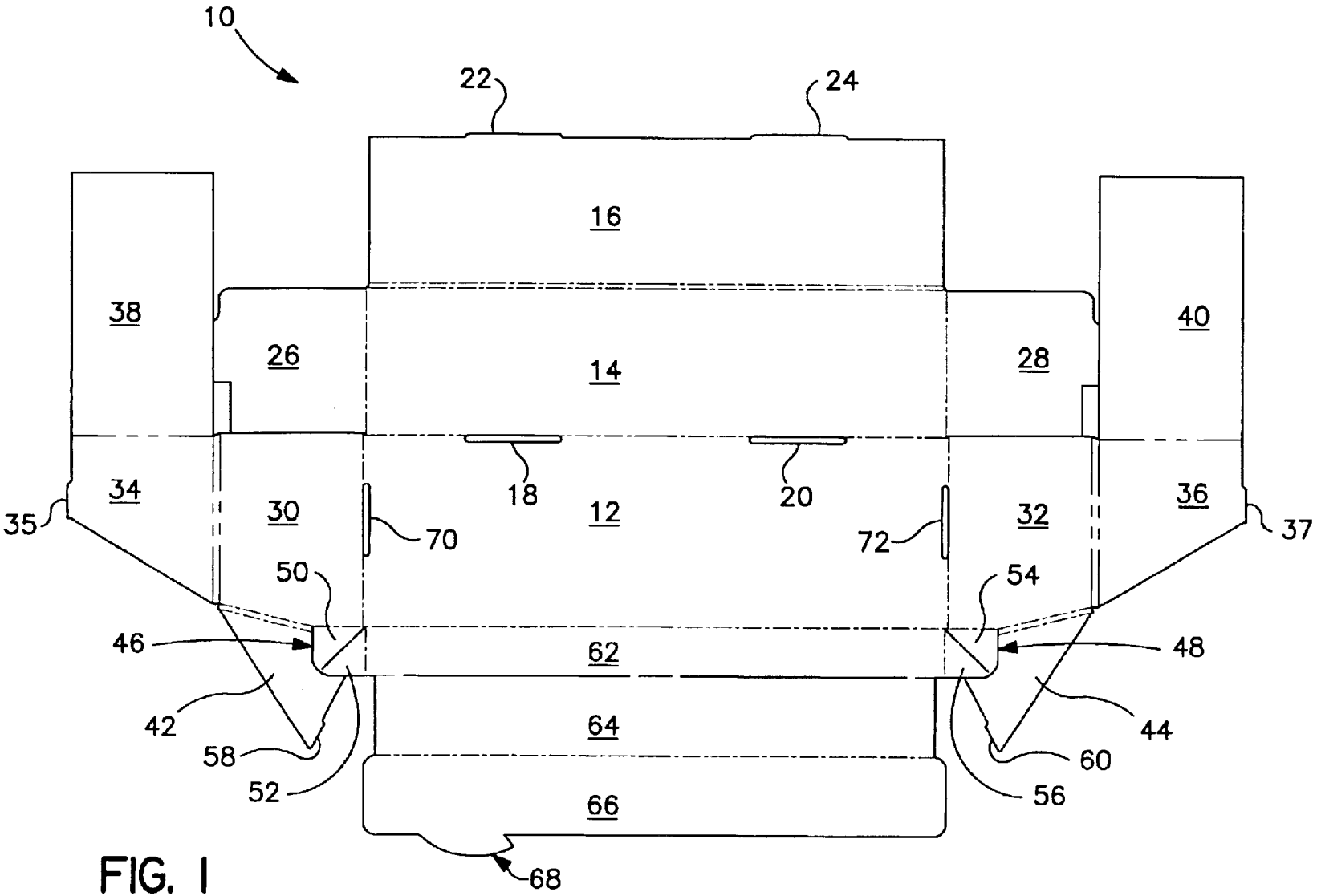
FIG. 1 is a plan view of a blank for a point of purchase display tray according to a preferred embodiment of the invention.

While this invention is susceptible of embodiment in many different forms, there are shown in the drawings and will be described in detail, several specific embodiments, with the understanding that the present disclosure is to be considered as an exemplification of the principles of the invention and is not intended to limit the invention to the embodiments illustrated.

FIG. 1 is a plan view of a blank for a point of purchase display tray according to a preferred embodiment of the invention. In FIG. 1, as in the other line drawing figures, unless otherwise noted, the usual convention for the illustration of paperboard blanks is observed that solid lines on the interior of a figure represent cuts, edges or points of inflection (like a ridge, crease or inwardly or outwardly projecting gusset), and broken or dashed lines indicate folds, score lines or other lines of weakness.

Figure 2:
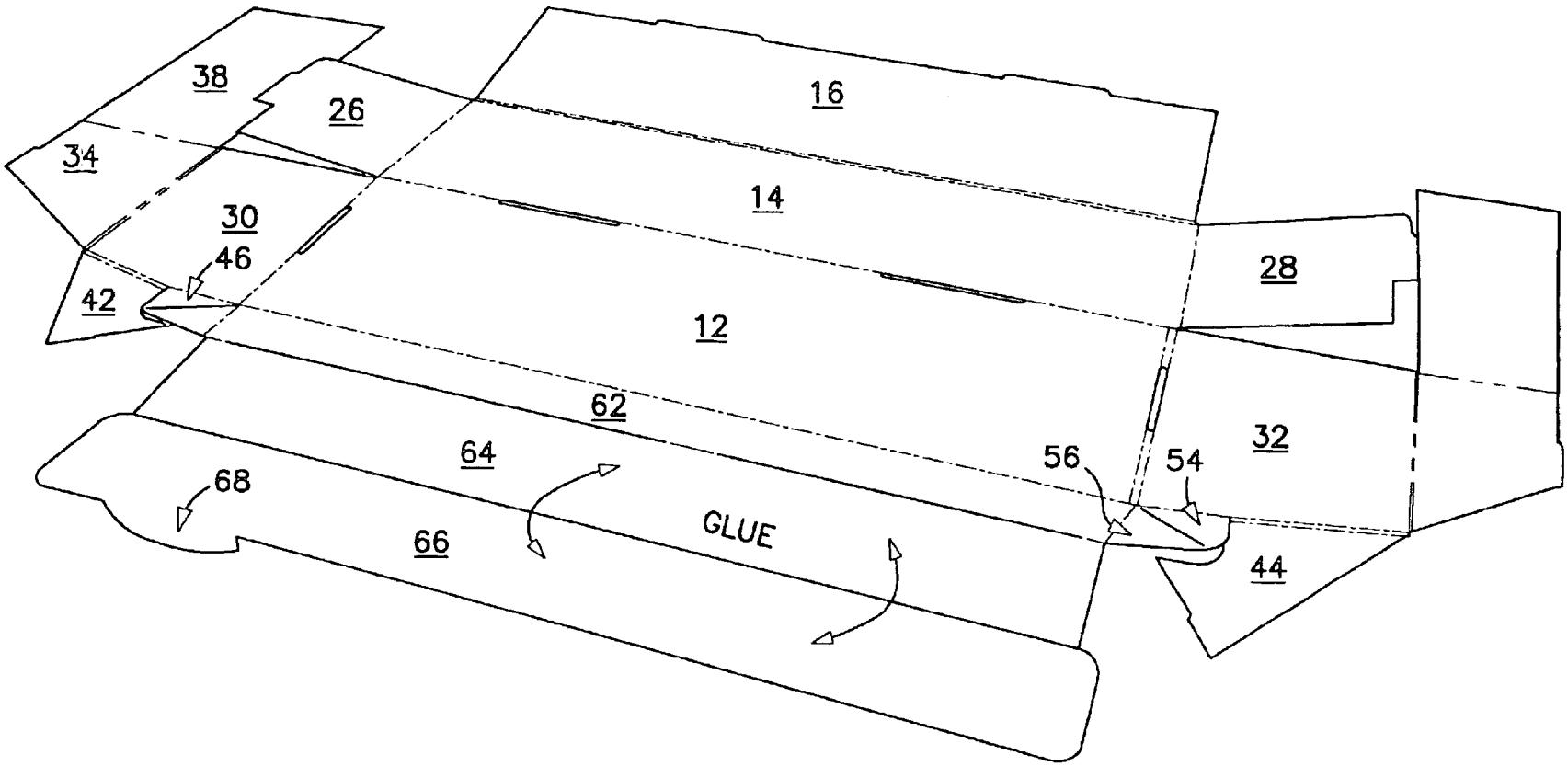
FIG. 2 is a perspective view of the blank for a point of purchase display tray according to the embodiment of FIG. 1.

Blank 10 includes bottom panel 12; outer back panel 14; inner back panel 16; bottom panel slots 18 and 20; inner back panel tabs 22 and 24; rear panel flaps 26 and 28; outer end panels 30, 32; inner partial end panels 34, 36; back reinforcing panels 38, 40; side panel flaps 42, 44 with locking tabs 58, 60, respectively; front panel gussets 46, 48, formed by foldably connected generally triangular panels 50, 52 and 54, 56, respectively; front panel 62; reinforcing panel 64 and indicia bearing panel 66, which may be provided with an ornamental design projection 68. FIG. 2 is a perspective photographic drawing of blank 10, in which exemplary fold lines have been emphasized.

FIGS. 2–8 are photographic drawings of an example of the point of purchase display fabricated from a blank 10, which is preferably fabricated from paper, paperboard or corrugated paperboard. The exemplary article illustrated in FIGS. 2–8 is formed from an unornamented blank. In a commercial embodiment of the invention, blank 10 would be printed with indicia (or have suitable decals or other signage) applied to the side of the blank that is opposite that shown in FIG. 2; that is, the underside of the blank illustrated in FIG. 2.

Figure 3:
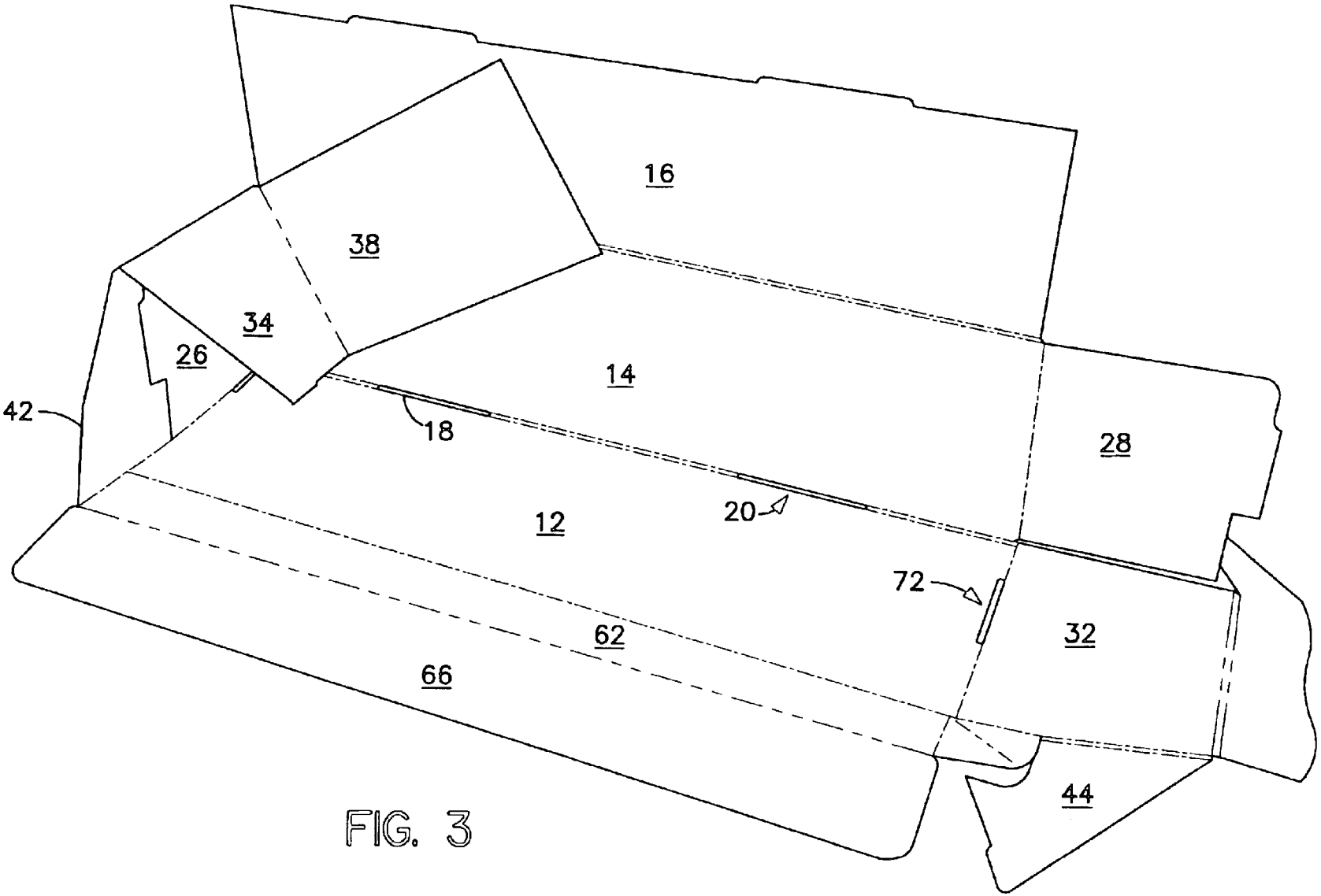
FIG. 3 is a perspective view of a point of purchase display, fabricated from the blank of FIG. 1, in an initial stage of articulation into display mode.
Figure 4:
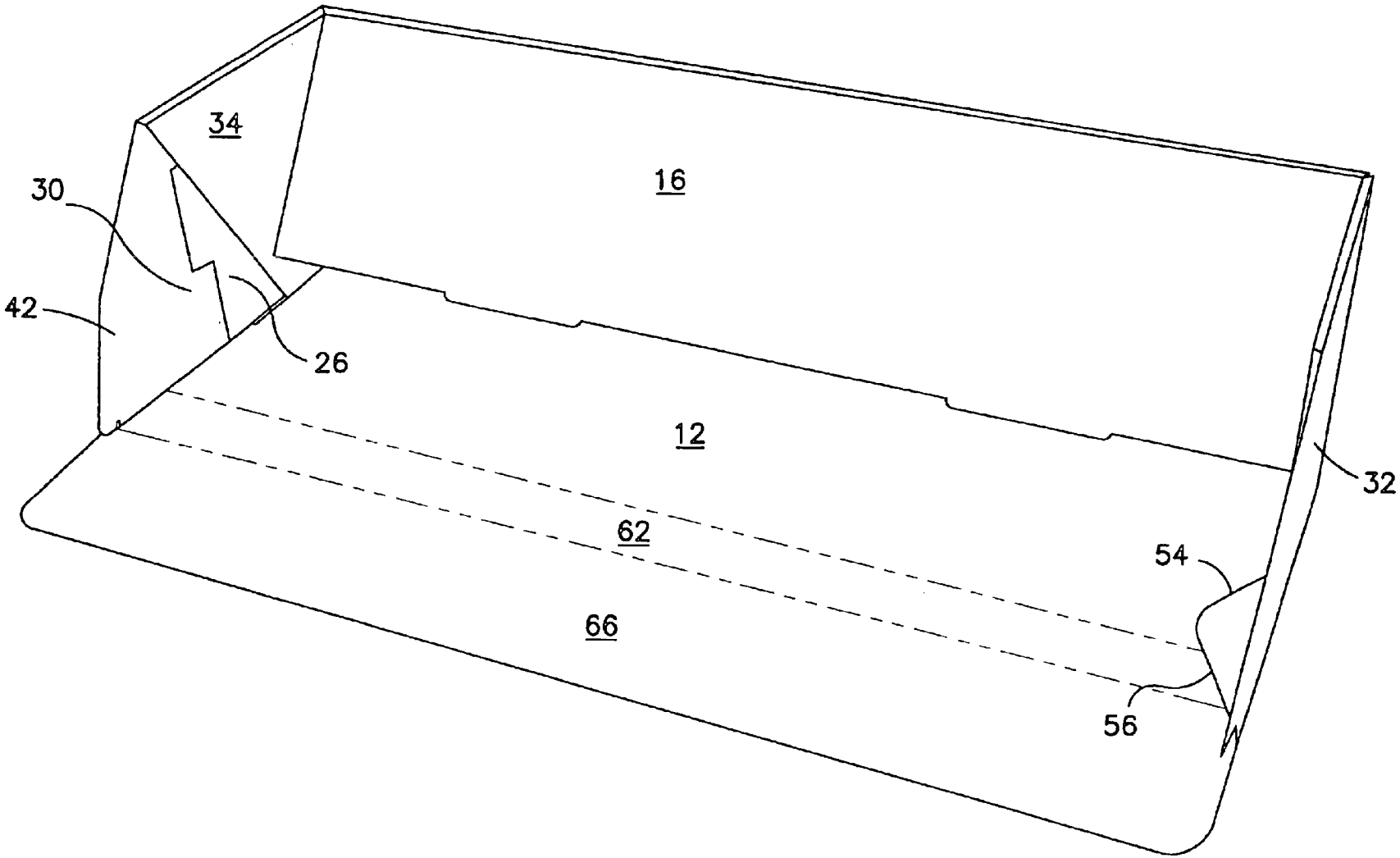
FIG. 4 is a perspective view of the point of purchase display of FIG. 1, shown in a later stage of articulation.

FIG. 3 is a perspective view of a point of purchase display, fabricated from the blank of FIG. 1, in an initial stage of articulation into display mode. Inner back panel 14 has been folded perpendicular to bottom panel 12, and rear panel flap 26 has been folded perpendicular to inner back panel 14. Outer end panel 30 has been folded up perpendicular to bottom panel 12. Inner partial end panel 34 has been folded down, toward a position overlying rear panel flap 26, while back reinforcing panel 38 is folded perpendicular to inner partial end panel 34, to be juxtaposed against the inner surface of outer back panel 14. To complete this initial stage of the articulation of blank 10, rear panel flap 28 will be folded perpendicular to inner back panel 14. Outer end panel 32 will be folded up perpendicular to bottom panel 12. Inner partial end panel 36 will be folded down, toward a position overlying rear panel flap 28, while back reinforcing panel 40 will be folded perpendicular to inner partial end panel 36, to be juxtaposed against the inner surface of outer back panel 14. Tabs 35 and 37 will be insertingly received in slots 70, 72 as well. The final step in the initial stage of articulation, is folding inner back panel 16 down to a position juxtaposed to back reinforcing panels 38, 40, so that inner back panel tabs 22, 24 are received in slots 18, 20, to maintain inner back panel 16 in place. In addition, indicia bearing panel 66 is folded back, over and against the inside surface of reinforcing panel 64 and affixed thereto, such as by adhesive, to form the display flap 70. FIG. 4 is a perspective view of the point of purchase display of FIG. 1, shown as this step is being completed.

Figure 5:
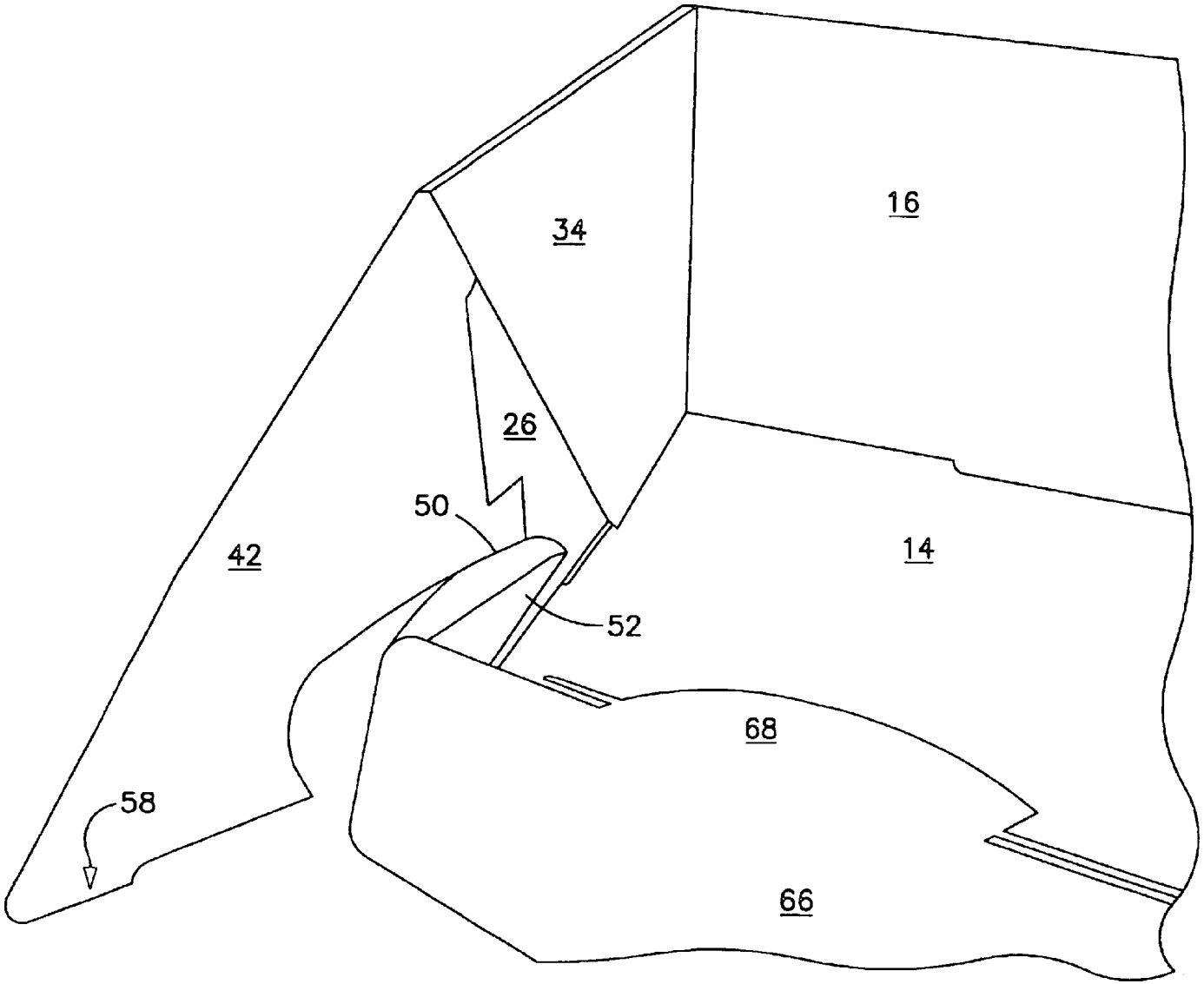
FIG. 5 is an enlarged perspective view of the point of purchase display of FIG. 1, showing a detail of how a minor flap emanating from an outer end panel is articulated.
Figure 6:
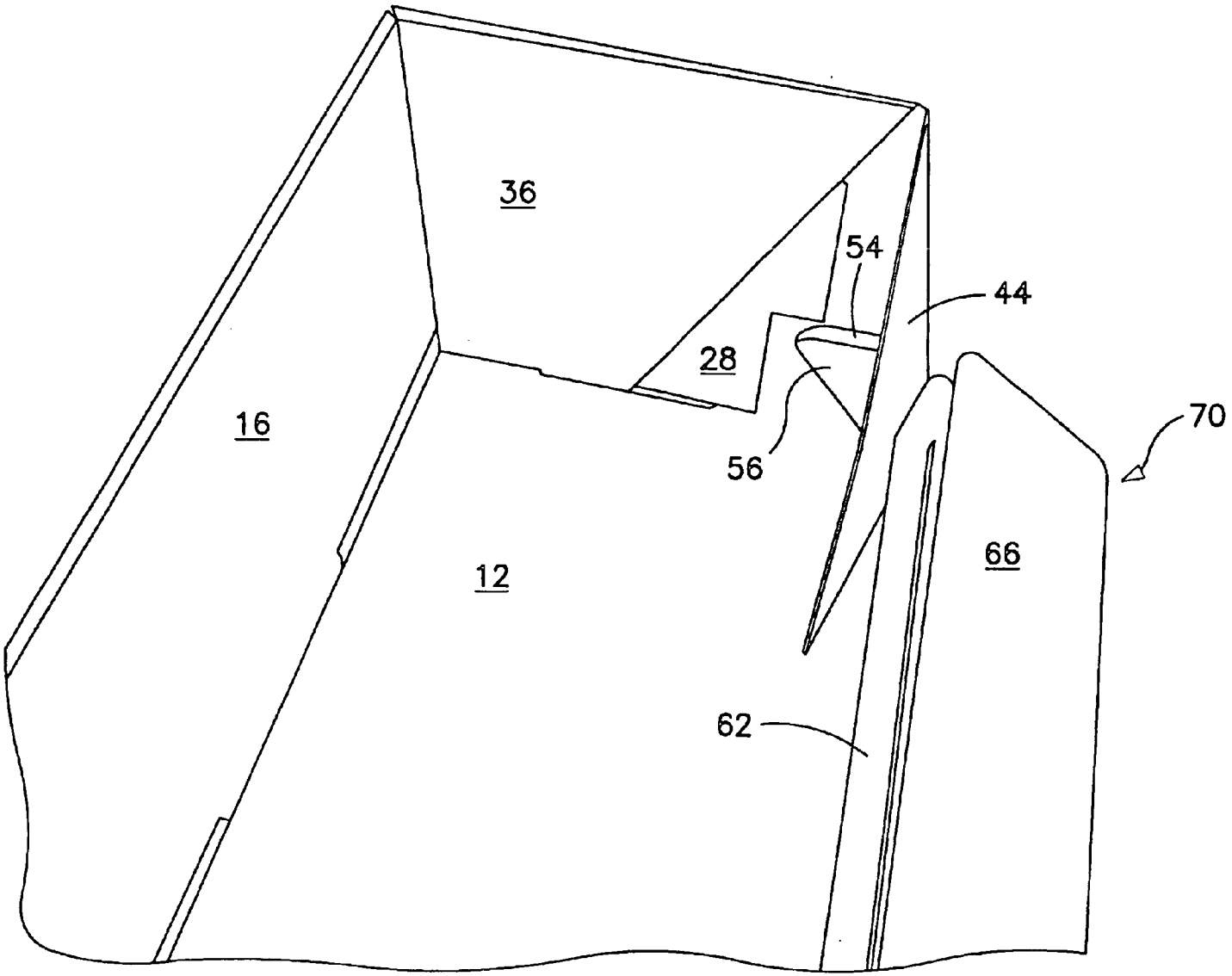
FIG. 6 is a view from the top, looking into the inside of an end region of the point of purchase display of FIG. 1.

FIG. 5 is an enlarged perspective view of the point of purchase display of FIG. 1, showing a detail of how side panel flap 42 emanating from outer end panel 30 is articulated. To enable conjoined reinforcing panel 64 and indicia bearing panel 66 to be folded up to a position substantially perpendicular to bottom panel 12, front panel gussets 46 and 48 (shown in FIG. 6) are formed by pivoting triangular panel pairs 50, 52 and 54, 56 (shown in FIG. 6) inwardly, relative to front panel 62 and respective outer end panels 30, 32. FIG. 6 is a view from the top, looking into the inside of an end region of the point of purchase display of FIG. 1. More or less simultaneously with the formation of the front panel gussets 46, 48, side panel flaps 42, 44 are folded inwardly toward one another, and then back toward inner rear panel 16, to overlie rear panel flaps 26, 28, respectively.

Figure 7:
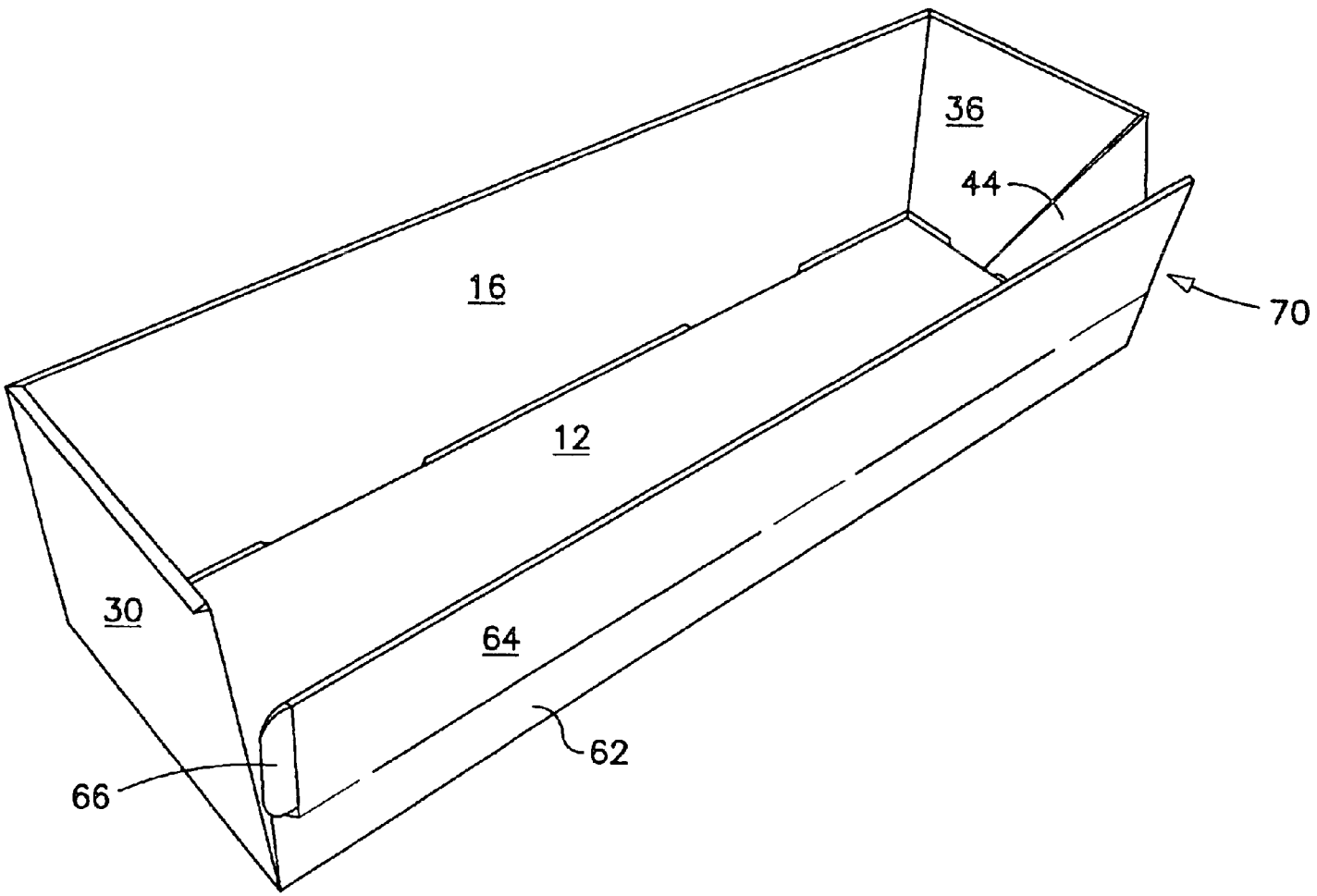
FIG. 7 is a top front perspective view of the point of purchase display of FIG. 1, shown in transit mode, with the display flap raised.

FIG. 7 is a top front perspective view of the point of purchase display of FIG. 1, shown in transit mode, with the display flap raised. In a preferred mode of operation of the invention, the goods (e.g., a plurality of rectangular parallelepiped cartons) will be stacked inside the point of purchase display, and display flap 70 will be folded upwardly to a position above and substantially parallel to front panel 62. The loaded point of purchase display tray will then be inserted into a suitable shipping container, for delivery to the vendor which will be displaying the merchandise in the display tray.

Figure 8:
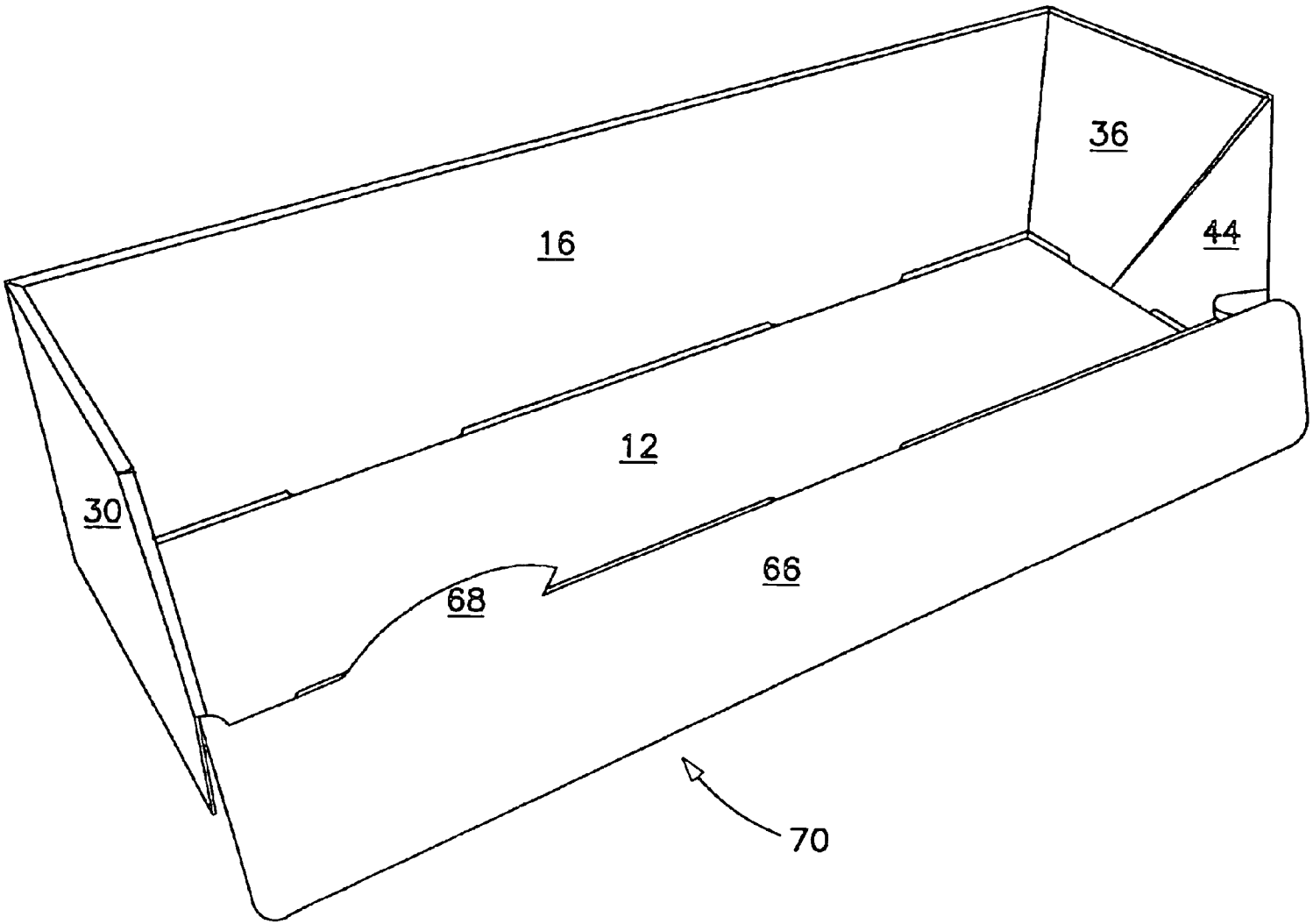
FIG. 8 is a top front perspective view of the point of purchase display of FIG. 1, shown in display mode, with the display flap dropped down.

Once the loaded display tray has been shipped to its ultimate destination, upon removal from the shipping container (not shown) the display tray is placed on the shelf or countertop, and the display panel is folded down, as shown in FIG. 8.

Figure 9:
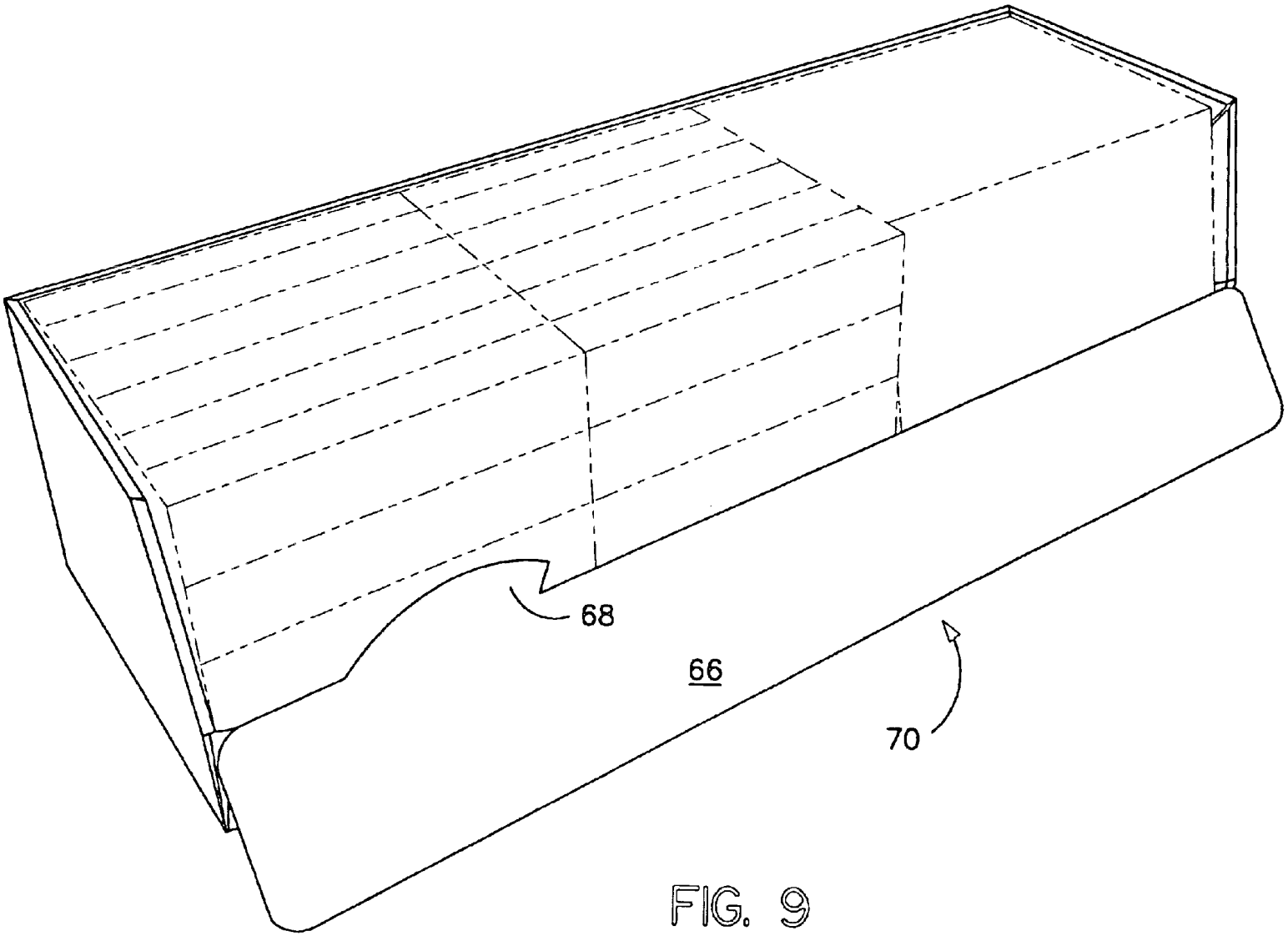
FIG. 9 is a front perspective view of a version of the point of purchase display formed from the blank of FIG. 1, to which indicia have been applied to the outer surface(s) of the blank.

A printed version of the point of purchase display tray formed from blank 10, of FIGS. 1–8 is shown in FIG. 9. As mentioned previously, indicia bearing panel 66 may include an ornamental portion 68, to accommodate design features of the particular indicia being printed on the outer surface(s) of the point of purchase display tray. In alternative embodiments of the invention, indicia bearing panel 66 may have any desired edge configuration or may have a simple rectangular configuration.

Figure 10:
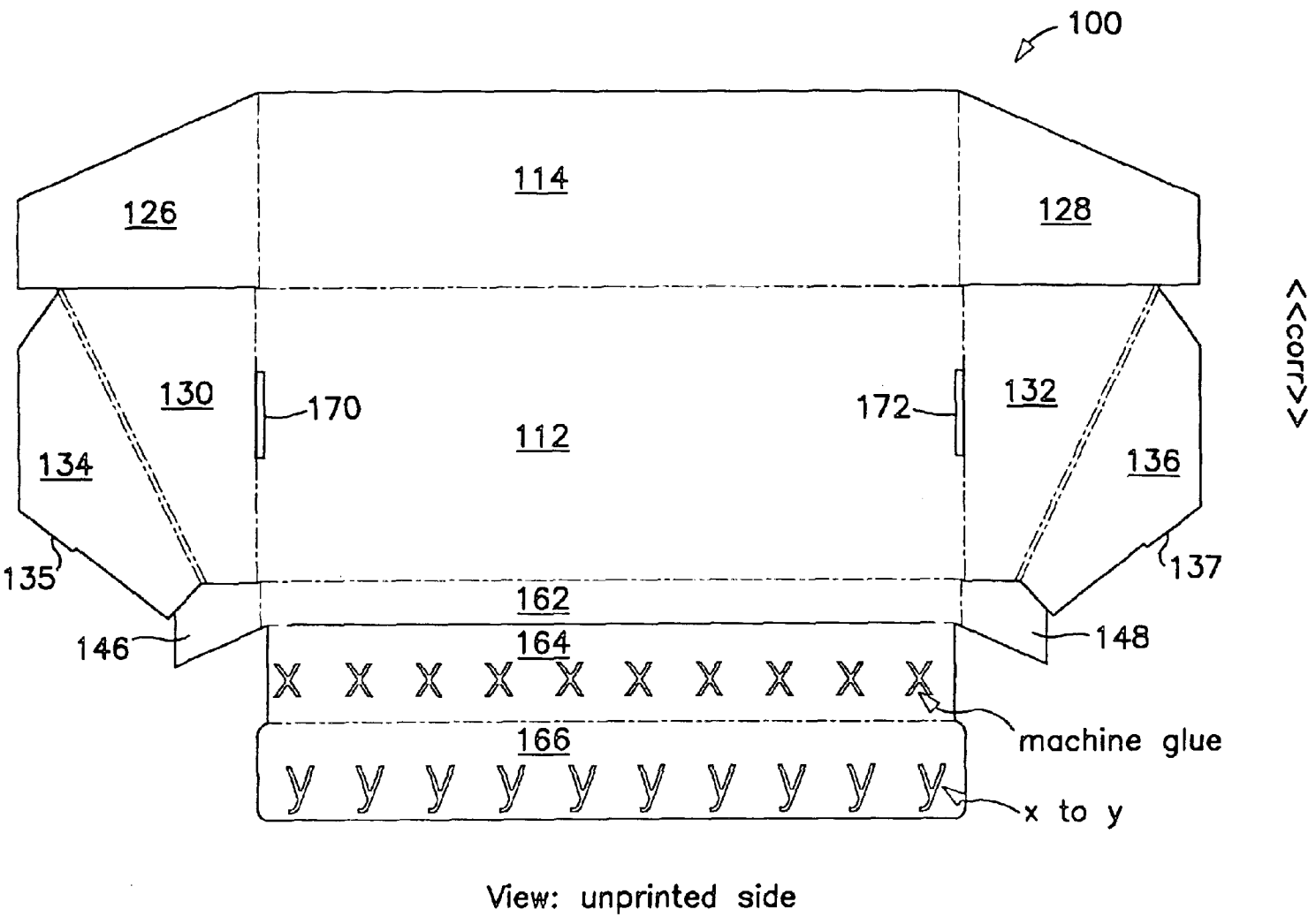
FIG. 10 is a plan view of a point of purchase display according to another preferred embodiment of the invention.

FIG. 10 is a plan view of a point of purchase display according to another preferred embodiment of the invention. Blank 100 includes bottom panel 112; rear panel 114; rear panel flaps 126, 128; outer end panels 130, 132; inner end panels 134, 136 with tabs 135, 137, respectively; front panel 162 with front panel flaps 146, 148; reinforcing panel 164 and indicia bearing panel 166. As in the embodiment of FIGS. 1–9, the primary display indicia that will placed on blank 100 will be printed on the "underside" of blank 100 (although some indicia may be printed on the "upper" or "inside" surfaces, to be disclosed, as the individual articles being displayed are successively removed from the display tray.

Articulation of the blank 100 is commenced by folding rear panel 114 upwardly perpendicular to bottom panel 112. Rear panel flaps 126 and 128 are then folded perpendicular to rear panel 114. Outer end panels 130, 132 are then folded up perpendicular to bottom panel 112. Front panel 162 is folded upwardly perpendicular to bottom panel 112, and front panel flaps 146, 148 are folded perpendicular to front panel 162, toward rear panel 114, and to the inside of and juxtaposed to the inside surfaces of outer end panels 130, 136, respectively. Inner side panels 134, 136 are then folded down, to overlie rear panel flaps 126, 128 and front panel flaps 146, 148, respectively, with tabs 135, 137 being received in slots 170, 172, respectively. Indicia bearing panel 166 is folded back over the "inside surface" of reinforcing panel 164 and affixed thereto, such as by any suitable adhesive. The method of loading, shipping and deploying the point of purchase display of FIG. 10 is preferably substantially the same as described with respect to the embodiment of FIGS. 1–9.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A point of purchase display tray for the containment and presentation of articles for vending, comprising:

a bottom panel, having a front edge, a rear edge and two side edges;

a first rear panel emanating upwardly from the rear edge of the bottom panel;

two first end panels, emanating upwardly from respective ones of the side edges of the bottom panel, a single front panel, emanating upwardly directly from the front edge of the bottom panel;

a single reinforcing panel, foldably emanating directly from a top edge of the front panel;

a single panel for bearing indicia, emanating upwardly directly from a lower edge of the reinforcing panel disposed distal to the top edge of the front panel, the panel for bearing indicia being folded back upon and affixed to the reinforcing panel, the single panel for bearing indicia and the reinforcing panel forming a display panel, which is pivotably connected to the front panel, and which display panel is substantially freely pivotable between a raised position above the front panel, and a display position outwardly and in front of the front panel, to expose indicia on the panel for bearing indicia, the single panel for bearing indicia having a free upper edge;

the bottom panel, first rear panel, first end panels, front panel, reinforcing panel and panel for bearing indicia all being monolithically formed as part of a single blank of material;

the panel for bearing indicia having a display surface that is exposed and outwardly facing when the panel for bearing indicia is in its display position, the display surface being disposed on a side of the blank in common with outwardly facing surfaces of the bottom panel, first rear panel, first end panels and front panel, so as to enable the single panel for bearing indicia, and the outwardly facing surfaces of the bottom panel, first rear panel, first end panels and front panel to be printed with indicia by a single printing pass performed on a single side of an unarticulated blank used to form the point of purchase display.

2. The point of purchase display tray according to claim 1, further comprising:

two rear panel flaps emanating from side edges of the first rear panel;

the two rear panel flaps being juxtaposed against respective inwardly facing surfaces of the two first end panels.

3. The point of purchase display tray according to claim 2, further comprising:

two second end panels, emanating downwardly from top edge regions of respective ones of the two first end panels, and juxtaposed against respective inwardly facing surfaces of the two rear panel flaps, so that the respective rear panel flaps are captured between respective pairs of first and second end panels.

4. The point of purchase display tray according to claim 3, further comprising:

at least one tab emanating from a free edge of at least one of the second end panels; and at least one slot disposed in the bottom panel, and operably positioned so as to insertingly receive the at least one tab when the respective at least one of the second end panels is juxtaposed against an inwardly facing surface of its corresponding rear panel flap.

5. The point of purchase display tray according to claim 1, further comprising:

a second rear panel, emanating from a top edge of the first rear panel, and extending downwardly toward the bottom panel.

6. The point of purchase display tray according to claim 5, further comprising:

at least one tab emanating from a bottom edge of the second rear panel; and at least one slot disposed in the bottom panel, operably positioned to insertingly receive the at least one tab.

7. The blank according to claim 1, further comprising:

two end panel flaps, foldably emanating from front edges of the two first end panels.

8. The blank according to claim 7, further comprising:

at least one tab emanating from an inner edge of at least one of the two end panel flaps; and at least one slot disposed in the bottom panel.

9. The point of purchase display tray according to claim 1, further comprising:

at least one gusset structure interconnecting the front panel with a corresponding at least one of the two first end panels.

10. The point of purchase display tray according to claim 1, further comprising:

at least one front panel flap emanating from an end edge of the front panel and extending rearwardly toward the rear edge of the bottom panel.

11. A blank for a point of purchase display tray for the containment and presentation of articles for vending, comprising:

a bottom panel, having a front edge, a rear edge and two side edges;

a first rear panel emanating from the rear edge of the bottom panel;

two first end panels, emanating from respective ones of the side edges of the bottom panel, a single front panel, emanating directly from the front edge of the bottom panel;

a single reinforcing panel, foldably emanating directly from an outer edge of the front panel;

a single panel for bearing indicia, emanating directly from an edge of the reinforcing panel disposed distal to the outer edge of the front panel, the panel for bearing indicia having a free outer edge extending the entire length of said front panel for bearing indicia disposed distal to said edge of the reinforcing panel;

the bottom panel, first rear panel, first end panels, front panel, reinforcing panel and panel for bearing indicia all being monolithically formed as part of the blank;

the panel for bearing indicia having a display surface disposed on a side of the blank in common with outwardly facing surfaces of the bottom panel, first rear panel, first end panels and front panel, so as to enable the single panel for bearing indicia, and the outwardly facing surfaces of the bottom panel, first rear panel, first end panels and front panel to be printed with indicia by a single printing pass performed on a single side of the unarticulated blank used to form a point of purchase display the height of said reinforcing panel is being greater than the height of said front panel.

12. The blank according to claim 11, further comprising:

at least one gusset structure interconnecting the front panel with a corresponding at least one of the two first end panels.

13. The blank according to claim 11, further comprising:

two rear panel flaps emanating from side edges of the first rear panel.

14. The blank according to claim 13, further comprising:

two second end panels, emanating from outer edge regions of respective ones of the two first end panels.

15. The blank according to claim 14, further comprising:

at least one tab emanating from a free edge of at least one of the second end panels; and at least one slot disposed in the bottom panel.

16. The blank according to claim 11, further comprising:

a second rear panel, emanating from an outer edge of the first rear panel.

17. The blank according to claim 16, further comprising:

at least one tab emanating from an outer edge of the second rear panel; and at least one slot disposed in the bottom panel.

18. The blank according to claim 11, further comprising:

at least one front panel flap emanating from an end edge of the front panel.

19. A point of purchase display tray for the containment and presentation of articles for vending, comprising:

a bottom panel, having a front edge, a rear edge and two side edges;

a first rear panel emanating upwardly from the rear edge of the bottom panel;

two first end panels, emanating upwardly from respective ones of the side edges of the bottom panel, a front panel, emanating upwardly from the front edge of the bottom panel;

a reinforcing panel, foldably emanating from a top edge of the front panel;

a panel for bearing indicia, emanating from an edge of the reinforcing panel disposed distal to the top edge of the front panel, the panel for bearing indicia being folded back upon and affixed to the reinforcing panel, to form a display panel pivotably connected to the front panel that is pivotably movable between a raised position above the front panel, and a display position outwardly and in front of the front panel, to expose indicia on the panel for bearing indicia, the bottom panel, first rear panel, first end panels, front panel, reinforcing panel and panel for bearing indicia all being monolithically formed as part of a single blank of material;

the panel for bearing indicia having a display surface that is exposed and outwardly facing when the panel for bearing indicia is in its display position, the display surface being disposed on a side of the blank in common with outwardly facing surfaces of the bottom panel, first rear panel, first end panels and front panel;

two rear panel flaps emanating from side edges of the first rear panel;

the two rear panel flaps being juxtaposed against respective inwardly facing surfaces of the two first end panels;

two second end panels, emanating downwardly from top edge regions of respective ones of the two first end panels, and juxtaposed against respective inwardly facing surfaces of the two rear panel flaps, so that the respective rear panel flaps are captured between respective pairs of first and second end panels; and reinforcing flaps, foldably emanating from rear edges of the second end panels and juxtaposed adjacent an inwardly facing surface of the first rear panel.

20. The point of purchase display tray according to claim 1, further comprising:

two end panel flaps, foldably emanating from front edges of the two first end panels and juxtaposed against inwardly facing surfaces thereof.

21. The point of purchase display tray according to claim 20, further comprising:

at least one tab emanating from a bottom edge of at least one of the two end panel flaps; and at least one slot disposed in the bottom panel, operably positioned to insertingly receive the at least one tab, when the respective end panel flap is juxtaposed against the inwardly facing surface of its corresponding one of the two first end panels.

22. A blank for a point of purchase display tray for the containment and presentation of articles for vending, comprising:

a bottom panel, having a front edge, a rear edge and two side edges;

a first rear panel emanating from the rear edge of the bottom panel;

two first end panels, emanating from respective ones of the side edges of the bottom panel, a front panel, emanating from the front edge of the bottom panel;

a reinforcing panel, foldably emanating from an outer edge of the front panel;

a panel for bearing indicia, emanating from an edge of the reinforcing panel disposed distal to the outer edge of the front panel, the bottom panel, first rear panel, first end panels, front panel, reinforcing panel and panel for bearing indicia all being monolithically formed as part of the blank;

the panel for bearing indicia having a display surface disposed on a side of the blank in common with outwardly facing surfaces of the bottom panel, first rear panel, first end panels and front panel;

two rear panel flaps emanating from side edges of the first rear panel;

two second end panels, emanating from outer edge regions of respective ones of the two first end panels; and reinforcing flaps, foldably emanating from rear edges of the second end panels.

23. A method for packaging, transporting and displaying goods, comprising the steps of:

providing a point of purchase display tray for the containment and presentation of articles for vending, the point of purchase display tray including a bottom panel, having a front edge, a rear edge and two side edges;

a first rear panel emanating upwardly from the rear edge of the bottom panel;

two first end panels, emanating upwardly from respective ones of the side edges of the bottom panel, a single front panel, emanating upwardly directly from the front edge of the bottom panel;

a single reinforcing panel, foldably emanating directly from a top edge of the front panel;

a single panel for bearing indicia, emanating upwardly directly from a lower edge of the reinforcing panel disposed distal to the top edge of the front panel, the panel for bearing indicia being folded back upon and affixed to the reinforcing panel, the single panel for bearing indicia and the reinforcing panel forming a display panel, which is pivotably connected to the front panel, and which display panel is substantially freely pivotable between a raised position above the front panel, and a display position outwardly and in front of the front panel to expose indicia on the panel for bearing indicia, the single panel for bearing indicia having a free upper edge;

the bottom panel, first rear panel, first end panels, front panel, reinforcing panel and panel for bearing indicia all being monolithically formed as part of a single blank of material;

the panel for bearing indicia having a display surface that is exposed and outwardly facing when the panel for bearing indicia is in its display position, the display surface being disposed on a side of the blank in common with outwardly facing surfaces of the bottom panel, first rear panel, first end panels and front panel, so as to enable the single panel for bearing indicia, and the outwardly facing surfaces of the bottom panel, first rear panel, first end panels and front panel to be printed with indicia by a single printing pass performed on a single side of an unarticulated blank used to form the point of purchase display;

providing indicia on the display surface of the panel for bearing indicia prior to articulation of the blank into the point of purchase display tray;

filling the point of purchase display tray with products;

positioning the display panel in its raised position;

placing the point of purchase display tray into a shipping container.

24. The method according to claim 23 further comprising the steps of:

transporting the shipping container to a store.

25. The method according to claim 24 further comprising the steps of:

opening the shipping container;

placing the point of purchase display tray on a surface;

positioning the display panel in the display position.

* * * * *